US010177541B2

(12) United States Patent
Borra et al.

(10) Patent No.: US 10,177,541 B2
(45) Date of Patent: Jan. 8, 2019

(54) CONCENTRIC ELECTRICAL DISCHARGE AEROSOL CHARGER

(71) Applicants: Centre National de la Recherche Scientifique (CNRS), Paris (FR); Universite Paris-SUD, Orsay (FR); Consejo Superior De Investigaciones Cientificas, Madrid (ES)

(72) Inventors: Jean-Pascal Borra, Velizy (FR); Manuel Alonso, Madrid (ES); Nicolas Jidenko, Saint Remy les Chevreuse (FR)

(73) Assignees: CENTRE NATIONAL DE LA RECHERCHE SCIENTIFIQUE (CNRS), Paris (FR); UNIVERSITE PARIS-SUD, Orsay (FR); SONSEJO SUPERIOR DE INVESTIGACIONES CIENTIFICAS, Madrid (ES)

( * ) Notice: Subject to any disclaimer, the term of this patent is extended or adjusted under 35 U.S.C. 154(b) by 92 days.

(21) Appl. No.: 14/655,541

(22) PCT Filed: Dec. 23, 2013

(86) PCT No.: PCT/EP2013/077949
§ 371 (c)(1),
(2) Date: Jun. 25, 2015

(87) PCT Pub. No.: WO2014/102258
PCT Pub. Date: Jul. 3, 2014

(65) Prior Publication Data

US 2015/0349501 A1 Dec. 3, 2015

(30) Foreign Application Priority Data

Dec. 28, 2012 (FR) ..... 12 62942

(51) Int. Cl.
*H01T 23/00* (2006.01)
*H05F 3/00* (2006.01)
(Continued)

(52) U.S. Cl.
CPC ..... *H01T 23/00* (2013.01); *B05B 5/0533* (2013.01); *B05B 5/0535* (2013.01); *H01T 19/00* (2013.01);
(Continued)

(58) Field of Classification Search
CPC ..... H01T 23/00; H01T 19/00
(Continued)

(56) References Cited

U.S. PATENT DOCUMENTS 5,012,159 A * 4/1991 Torok ..... B03C 3/38 250/324
6,082,628 A * 7/2000 Hutchins ..... B05B 5/032 239/3
(Continued)

OTHER PUBLICATIONS

French Preliminary Search Report for Application No. FR1262942 dated Sep. 6, 2013.

*Primary Examiner* — Thienvu Tran
*Assistant Examiner* — Lucy Thomas
(74) *Attorney, Agent, or Firm* — Baker & Hostetler LLP

(57) ABSTRACT

The invention concerns an aerosol charger having electrical discharge comprising:
a body (2);
an ion source (3) comprising two electrodes (31, 32); the charger being characterized in that
the body (2) and at least a first electrode (32) of the ion source (3) are aligned along a same axis of longitudinal symmetry (AA') of the charger, the body (2) surrounding the first electrode (32) in such a way as to define an area (5) for an aerosol to flow between a space defined between the body (2) and the first electrode (32); and in that
(Continued)

the first electrode (32) comprises a hole (321) in communication with the area (5) for the aerosol (Ae) to flow, the hole (321) being designed to allow ions formed at the ion source (3) to pass therethrough in order for them to mix with an aerosol (Ae) flowing in the area (5) for the aerosol (Ae) to flow.

19 Claims, 5 Drawing Sheets

(51) Int. Cl.
*B05B 5/053* (2006.01)
*H01T 19/00* (2006.01)
*H05H 1/48* (2006.01)
*B05B 5/057* (2006.01)

(52) U.S. Cl.
CPC ..... *H05H 1/48* (2013.01); *B05B 5/057* (2013.01); *H05H 2001/483* (2013.01)

(58) Field of Classification Search
USPC ..... 361/231
See application file for complete search history.

(56) References Cited

U.S. PATENT DOCUMENTS 6,302,331 B1 * 10/2001 Dvorsky ..... A61M 15/02 239/3
6,508,982 B1 * 1/2003 Shoji ..... A61L 9/22 204/164
2005/0083633 A1 4/2005 Riebel et al.
2011/0090611 A1 4/2011 Tsai et al.

* cited by examiner

FIG. 1bis
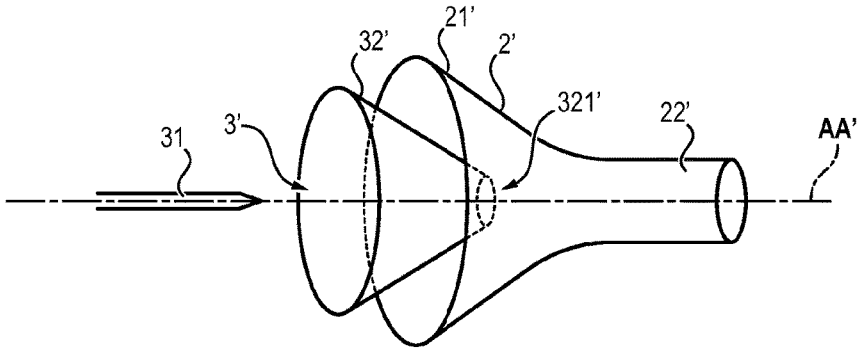
FIG. 1ter
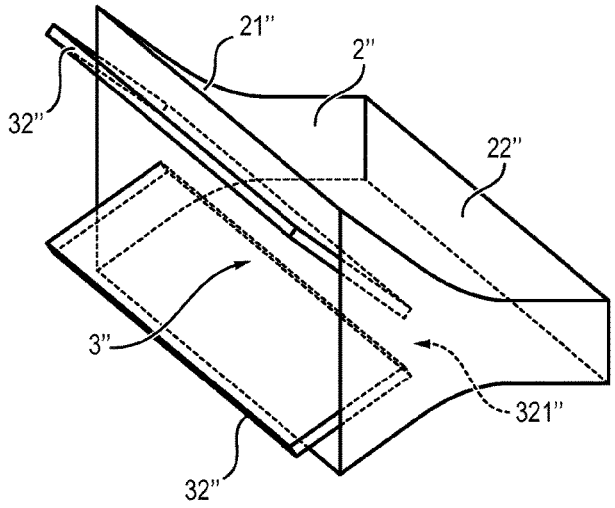

CONCENTRIC ELECTRICAL DISCHARGE AEROSOL CHARGER

CROSS REFERENCE TO RELATED APPLICATIONS

The present application is a national phase entry under 35 U.S.C. § 371 of International Application No. PCT/EP2013/077949, filed Dec. 23, 2013, published in French, which claims priority from French Patent Application No. 1262942, filed Dec. 28, 2012, the disclosure of which are incorporated by reference herein.

FIELD OF THE INVENTION

The present invention relates to a device for charging an aerosol and more particularly relates to a device for charging an aerosol using a continuous corona-type discharge.

PRIOR ART

Various types of devices using a corona discharge to charge an aerosol are known. However these devices have many drawbacks.

Firstly, a large proportion of the ions produced by these chargers are collected on the walls of the charger. Improvements have been proposed in order to reduce the quantity of ions collected on the walls. The document US 2011/0090611, for example, describes a charger wherein a fast stream of air is created near the inner wall of the charger in such a way as to reduce the collection of ions on the walls. However, in this type of device, the electrodes are in contact with the aerosol: a fraction of the aerosols becomes charged by collection of ions produced by the discharge and a fraction of this fraction is collected electrostatically on the electrodes, which results in a modification of the shape and the nature of the electrodes, and therefore a modification of the discharge and a discharge stability problem. Electric discharges produce reactive gas species that can react with the gas species of the aerosol to form condensable gas species, which give rise to new particles affecting the granulometric distribution of the aerosol to be characterized. The electric discharges also produce ozone and nitrogen oxides, these gas species are oxydants and therefore liable to damage materials or have adverse effects on health.

Devices have been proposed wherein the ions are produced outside the area for the aerosol to flow, then driven by an air stream in the direction of the area for the aerosol to flow in. However, in this type of device, a large proportion of the ions produced is collected on the walls of the charger.

None of the devices proposed this far enables efficient reduction of both the collection of aerosol on the electrodes and the collection of the ions produced by the discharge on the charger walls.

SUMMARY OF THE INVENTION

The invention makes it possible to palliate at least one of the aforementioned drawbacks by proposing a device making it possible to charge the particles more efficiently while limiting both the loss of ions on the walls and the collection of aerosol on the electrodes.

For this purpose, the invention proposes an electrical discharge aerosol charger comprising a body, an ion source comprising two electrodes; the charger being characterized in that the body and at least a first electrode of the ion source are aligned along a same longitudinal axis of symmetry of the charger, the body surrounding the first electrode in such a way as to define an area for an aerosol to flow between a space defined between the body and the first electrode, and in that the first electrode comprises a hole in communication with the area for the aerosol to flow, the hole being designed to allow ions formed at the ion source to pass therethrough in order for them to mix with an aerosol flowing in the area for the aerosol to flow.

The invention is advantageously completed by the following features, taken individually or in any technologically possible combination:

- the ion source further comprises a second electrode aligned with the body and the first electrode on the longitudinal axis of symmetry of the charger;
- the second electrode is a tip or a wire;
- the body is a duct composed of a first flared segment and a second straight segment, the first electrode being positioned at the center of the first flared segment;
- the first electrode is tapered in shape, the body being composed of a cone extended by a tube;
- the first electrode is composed of two plates, mutually symmetrical with respect to the longitudinal axis of symmetry of the charger;
- the aerosol charger further comprises a voltage generator making it possible to set up a DC voltage between the first and the second electrode;
- the aerosol charger further comprises a ballast resistor placed in series with the generator;
- the first electrode is composed of a layer of insulating material surrounded by an outer metallic layer and an inner metallic layer, the charger further comprising a voltage generator making it possible to set up a DC voltage between the two metallic layers of the electrode;
- the aerosol charger further comprises a voltage generator making it possible to set up a DC voltage between the externed metallic layer of the first electrode and the body;
- the aerosol charger further comprises successive rings polarised with the same polarity as the particles and positioned at the narrowed part of the body, in such a way as to confine the ions in the center of the narrowed part of the body by electrostatic repulsion;
- the narrowed part of the body is composed of two hemicylindrical electrodes, powered by an AC current generator, in such a way as to form an oscillating field in the narrowed part of the body;
- the narrowed part of the body is composed of three electrodes powered by a three-phase current generator, in such a way as to form a rotating field in the narrowed part of the body.

The invention has a particular application in measurement of the size and concentration of aerosols by the use of an electrical mobility analyzer. The particles are introduced in the form of an aerosol into the charger according to the invention, where they receive a definite charge. The particles are sorted by an electrostatic field in a differential mobility analyzer. The aerosols are then counted by electrical mobility range. The electrical mobility being related to the size of the particles, an inversion of the data makes it possible to obtain the size distribution of the particles.

The invention also has an application in various methods requiring very good control of the charge of particles, and in particular filtering by electrostatic collection of particles in suspension, the focused deposition of particles, or bipolar coagulation.

BRIEF DESCRIPTION OF THE FIGURES

Other features, aims and advantages of the present invention will become apparent upon reading the following detailed description, given by way of non-limiting example and with reference to the appended figures, among which:

FIGS. 1*bis* and 1*ter* are representations in space of two variants of the device according to the invention;

In all the figures, similar elements bear identical reference numbers.

DETAILED DESCRIPTION

Figure 1:
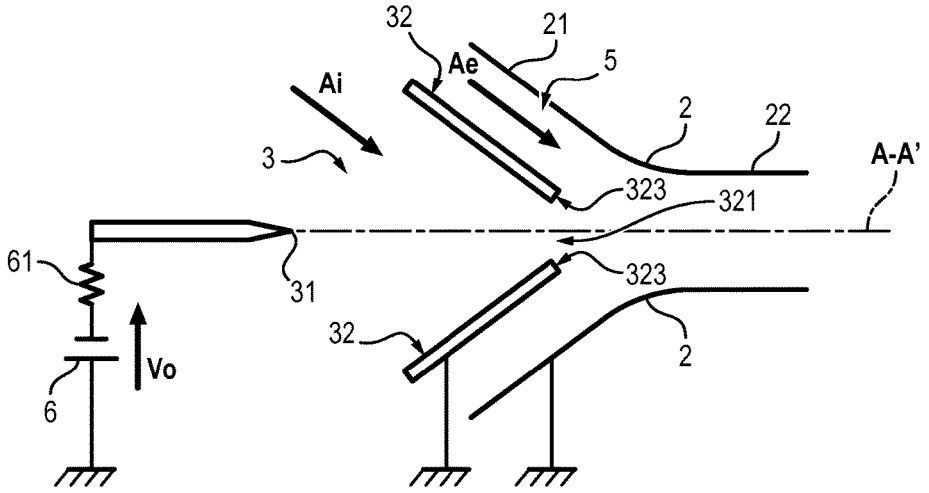
FIG. 1 is a longitudinal section view of an aerosol charger according to the invention.

With reference to FIG. 1 a corona discharge aerosol charger according to the invention comprises a body 2, a second electrode 31 in the shape of a tip and a first electrode 32. The first 32 electrode and the second 31 electrode define between them a source of ions 3 where ions are formed by corona effect. The distance between the first electrode and the second electrode is typically between 1 and 10 mm. The first electrode can also be a wire or any other object having a low radius of curvature.

The aerosol charger further comprises a voltage generator 6 which makes it possible to set up a DC voltage between the first 32 and the second 31 electrode in order to generate ions by corona effect between the two electrodes 31 and 32.

The body 2 and the first electrode 32 are hollow and are aligned with the second electrode 31 on a same longitudinal axis of symmetry AA' of the charger. The body 2 surrounds the first electrode 32 in such a way as to define an area 5 for the aerosol to flow Ae in a space defined between the body 2 and the first electrode 32. The aerosol Ae to be charged is injected between the body 2 and the first electrode 32. The first electrode 32 comprises a hole 321, 321', 321" in communication with the area 5 for the aerosol to flow in, the hole 321, 321', 321" being adapted to let through ions formed by corona discharge between the first 32 and the second 31 electrode in order that they mix with the aerosol Ae flowing in the area 5 for the aerosol Ae to flow. The ions are injected into the center of the particles to be charged, which has the effect of limiting ion loss on the walls of the charger.

Advantageously, a stream of dry air Ai is introduced into the hole 321, 321', 321", in such a way as to drive the ions formed by corona discharge toward the area 5 for the aerosol Ae to flow. The charging of the aerosol Ae takes place post-discharge. The ions are extracted from the ion source 3 by convection and mixed with the aerosol Ae, thus limiting the collection of aerosol on the electrodes 32 and 31 and thus the destabilization of the discharge.

The body 2, 2', or 2" is a duct composed of a first flared segment 21, 21', or 21" and a second straight segment 22, 22', or 22". The first electrode 32 is placed in the center of the flared part 21, 21', 21" of the body 2, 2', 2".

With reference to FIGS. 1*bis* and 1*ter* we will now describe two variant embodiments of a device according to the invention.

In a first variant embodiment illustrated by FIG. 1*bis*, the first electrode 32' is tapered in shape and hollow so as to guide the stream of dry air Ai in the direction of the hole 321, 321', 321". The body 2' is composed of a cone 21' extended by a tube 22'. The first electrode 32' is placed in the center of the body 2' in such a way that the stream of aerosol injected between the first electrode 32' and the hollow cone 21' is evacuated by the tube 22' after being charged with ions at the hole of the first electrode 321, 321', 321".

In a second variant embodiment illustrated by FIG. 1*ter*, the first electrode 32" is composed of two plates mutually symmetrical with respect to the longitudinal axis of symmetry AA' of the charger. The body 2" is a duct of rectangular cross section composed of a first flared segment 21" and a second straight segment 22".

Figure 4:
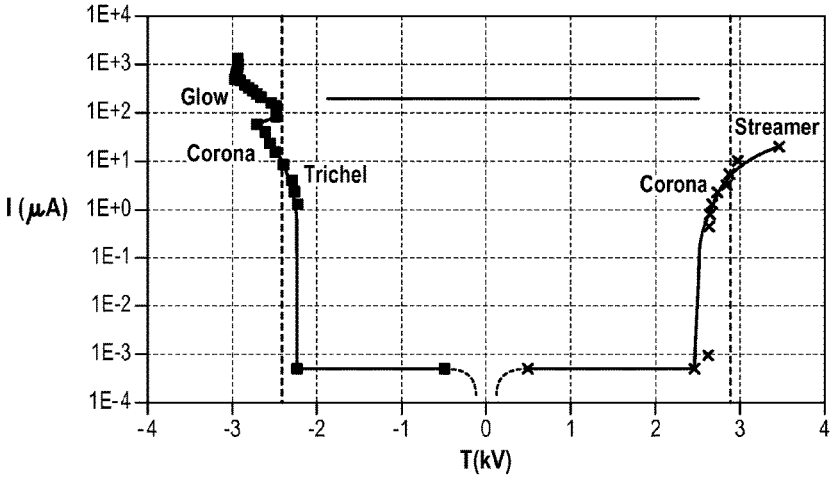
FIG. 4 represents the current-voltage characteristic of a plasma discharge obtained with the invention.

As can be seen in FIG. 4, the current I/voltage T characteristic of a plasma discharge is not linear. The current I/voltage T characteristic of a plasma discharge depends on the polarity of the second electrode 31. If the second electrode 31 has a higher potential than the first electrode 32, the following succession of regimes of discharge is observed. When the voltage is relatively low, the electric field applied between the two electrodes 31 and 32 only drives the ions and the electrons present in air because of ambient radioactivity. These ions and electrons migrate toward the electrodes 31 and 32 in the applied electric field while producing a low current. This regime is called the "Background ionization" regime. If the voltage between electrodes 31 and 32 is sufficiently increased, all the electrons produced by radioactivity are captured and the current saturates. If the voltage increases until the electrons initially present in the gas acquire enough energy to ionize a neutral atom, the current then increases exponentially with the voltage. This regime is called the "Townsend regime". If the voltage is further increased, the discharge enters the "Trichel" regime wherein the current is pulsed then the "Corona" regime wherein the instantaneous current is constant. If the voltage is further increased, the electric break point is reached, electrons are emitted by the cathode after impact with an ion or a photon and the current drops. The discharge then enters the so-called "Glow" regime. If the voltage increases until the electrodes 31 and 32 become hot enough for the cathode to emit ions thermally, the creation of an arc is observed.

If the second electrode 31 has a lower potential than the first electrode 32, the series of discharge regimes is as follows. First the Townsend regime is observed, then the "Corona" regime. If the current is further increased, the discharge filament joins the two electrodes. This regime is called the "streamer" regime. Finally, if the voltage further increases until the electrodes 31 and 32 become hot enough for the cathode to emit ions thermally, the creation of an arc is observed.

The "Trichel" regime, the "Corona" regime and the "Glow" regime are the most propitious regimes to the formation of charged species. The "streamer" regime is ruled out because the filaments vaporize part of the electrodes, which leads to the formation of particles. The applied voltage between the first electrode 32 and the second electrode 31 makes it possible to determine the discharge regime. In the case of the "Trichel" and "Corona" regimes, it is not necessary to add a Ballast resistor to stabilize the discharge. On the other hand, in the case of the "Glow" regime, a ballast resistor 61 is preferably added, placed in series with the generator 6 to stabilize the discharge in the "Glow" regime.

Figure 2:
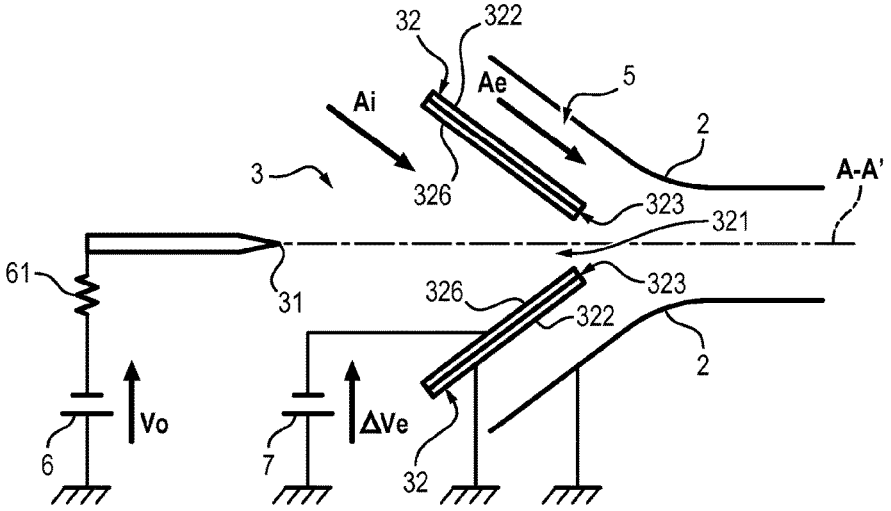
FIGS. 2 and 3 are longitudinal section views of two variants of aerosol charger according to the invention.

The concentric injection of the ions in the center of the particles to be charged makes it possible to limit ion loss on the charger walls. However, part of the ions is still collected on the edge 323 of the first electrode 31 when they pass through the hole 321, 321', 321" of the first electrode. To further limit these losses, the first electrode 32 can be composed of a layer of insulating material 324 (with reference to FIG. 2), surrounded by an outer metallic layer 322 and an inner metallic layer 326, the charger further comprising a voltage generator 7 making it possible to set up a DC voltage between the two metallic layers 322 and 326 of the electrode, typically of a few hundred volts. The voltage difference between the two metallic layers 322 and 326 of the first electrode 32 creates an electrostatic field that increases the velocity of the ions as they pass through the hole 321, 321', 321", and thus limits the quantity of ions collected on the first electrode 32 at the hole 321, 321', 321".

Figure 3:
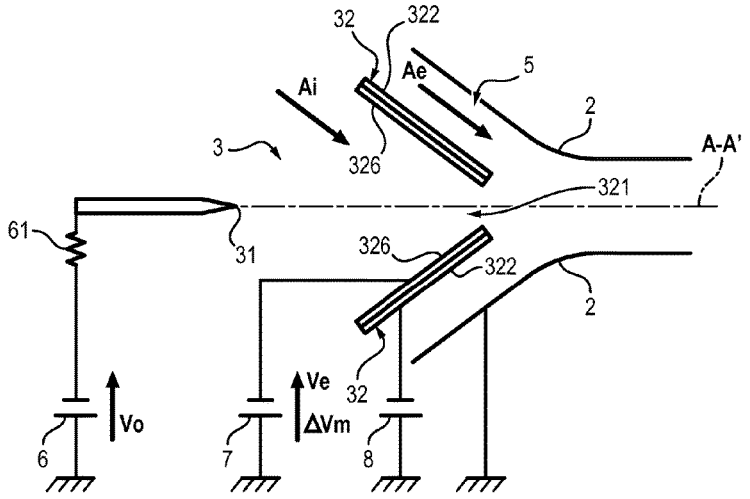

Moreover, a fraction of the ions extracted from the hole 321, 321', 321" of the first electrode 32 is collected on the outer metallic layer 322 of the first electrode 32, this fraction is useless for charging aerosols. To limit this effect, a voltage generator 8 is advantageously added (with reference to FIG. 3) making it possible to set up a DC voltage, typically of a few hundred volts, between the outer metallic layer 326 of the first electrode 32 and the body 2. The potential difference between the first electrode 32 and the body 2 creates an electrostatic field between the body 2 and the first electrode 32 which limits the collection of ions collected on the first electrode 32.

Figure 5A:
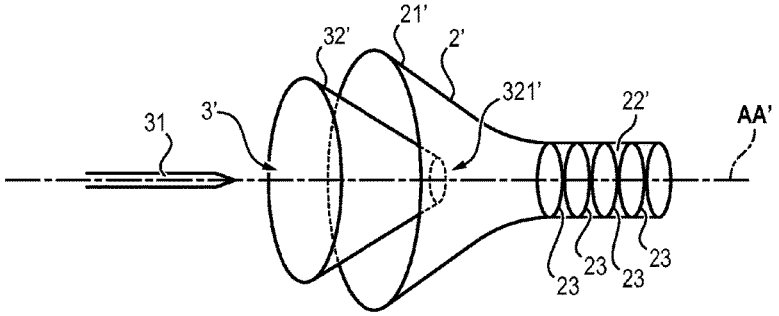
FIG. 5*a* is a representation in space of a variant of the device according to the invention.
Figure 5B:
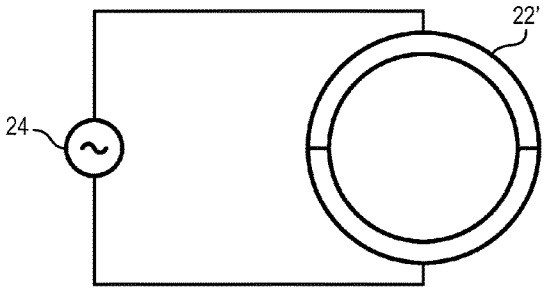
FIGS. 5*b* and 5*c* are transverse section views of two variants of the device according to the invention.
Figure 5C:
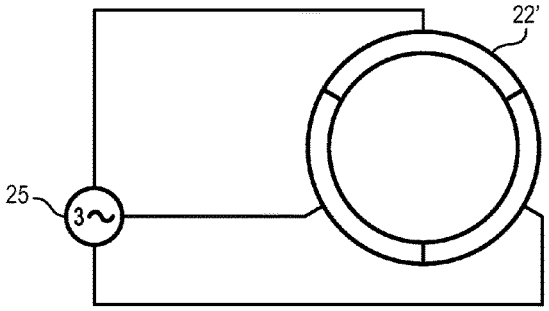

With reference to FIGS. 5*a*, 5*b* and 5*c* we will now describe three variant embodiments of a device according to the invention.

In order to limit the loss of particles on the walls of the body 2, 2' or 2", it is advantageously possible to place successive rings 23 (with reference to FIG. 5*a*) polarised with the same polarity as the particles at the narrowed part 22, 22', 22" of the body 2, 2', 2", in such a way as to confine the ions in the center of the narrowed part 22, 22', 22" of the body 2, 2', 2" by electrostatic repulsion.

Advantageously, the narrowed part 22, 22', 22" of the body 2, 2', 2" can be composed of two semicylindrical electrodes, powered by an AC current generator 24 (with reference to FIG. 5*b*), in such a way as to form an oscillating field in the narrowed part 22, 22', 22" of the body 2, 2', 2".

Advantageously, the narrowed part 22, 22', 22" of the body 2, 2', 2" can be composed of three electrodes powered by a three-phase current generator 25 (with reference to FIG. 5*c*), in such a way as to form a rotating field in the narrowed part 22, 22', 22" of the body 2, 2', 2".

The invention claimed is:

1. Electrical discharge aerosol charger comprising:

a body comprising a flared segment extended by a straight segment, the flared segment narrowing from an inlet opening to an outlet opening at the extremity of the straight segment, an ion source comprising a first electrode and a second electrode, wherein the second electrode is tip shaped, said first and second electrodes being disposed along a center line of the flared segment with the first electrode being axially interposed between the second tip-shaped electrode and walls of the flared segment, defining an ion formation zone upstream of the straight segment between the electrodes; the electrical discharge aerosol charger being wherein the body and at least the first electrode of the ion source are aligned on a same longitudinal axis of symmetry of the electrical discharge aerosol charger, the body surrounding the first electrode; the electrical discharge aerosol charger comprising an area surrounding the first electrode, between the body and the first electrode, so that aerosols are able to flow into said area from the flared segment and to converge into the straight segment; and in that the first electrode comprises a hole aligned with the second electrode and extending around the longitudinal axis of symmetry of the electrical discharge aerosol charger, said hole being in communication with the area so that ions formed coming from the ion source mix with an aerosol flowing in the area, the mixing beginning at the hole, and wherein the first electrode is composed of a layer of insulating material, surrounded by an outer metallic layer and an inner metallic layer, the electrical discharge aerosol charger further comprising a voltage generator configured to set up a DC voltage between the two metallic layers of the electrode.

2. The electrical discharge aerosol charger according to claim 1, wherein the first electrode is composed of two plates mutually symmetrical with respect to the longitudinal axis of symmetry of the electrical discharge aerosol charger.

3. The electrical discharge aerosol charger according to claim 1, further comprising a voltage generator configured to set up a DC voltage between the first and the second electrode.

4. The electrical discharge aerosol charger according to claim 3, further comprising a ballast resistor placed in series with the generator.

5. The electrical discharge aerosol charger according to claim 1, further comprising a voltage generator configured to set up a DC voltage between the outer metallic layer of the first electrode and the body.

6. The electrical discharge aerosol charger according to claim 1, further comprising successive rings polarised with the same polarity as the particles and positioned at the narrowed part of the body, in such a way as to confine the ions in the center of the narrowed part of the body by electrostatic repulsion.

7. The electrical discharge aerosol charger according to claim 1, wherein the narrowed part of the body is composed of two semicylindrical electrodes, powered by an AC current generator, in such a way as to form an oscillating field in the narrowed part of the body.

8. The electrical discharge aerosol charger according to claim 1, wherein the narrowed part of the body is composed of three electrodes powered by a three-phase current generator, in such a way as to form a rotating field in the narrowed part of the body.

9. The electrical discharge aerosol charger according to claim 1, wherein the first electrode is tapered in shape, the body being composed of a cone extended by a tube.

10. The electrical discharge aerosol charger according to claim 1, wherein the first electrode is composed of two plates mutually symmetrical with respect to the longitudinal axis of symmetry of the electrical discharge aerosol charger.

11. The electrical discharge aerosol charger according to claim 1, further comprising a voltage generator configured to set up a DC voltage between the first and the second electrode.

12. The electrical discharge aerosol charger according to claim 11, further comprising a ballast resistor placed in series with the generator.

13. Electrical discharge aerosol charger comprising:

a body comprising a flared segment and a straight segment, the flared segment narrowing from an inlet opening to an outlet opening at the extremity of the straight segment;

an ion source comprising a first electrode and a second electrode; the electrical discharge aerosol charger being wherein the body and at least the first electrode of the ion source are aligned on a same longitudinal axis of symmetry of the electrical discharge aerosol charger, the body surrounding the first electrode in such a way as to define an area for an aerosol to flow between a space defined by the body and the first electrode; and in that the first electrode comprises a hole aligned with the second electrode and extending around the longitudinal axis of symmetry of the electrical discharge aerosol charger, the hole being in communication with the area so that ions formed coming from the ion source mix with an aerosol flowing in the area the mixing beginning at the hole;

wherein the first electrode is composed of a layer of insulating material, surrounded by an outer metallic layer and an inner metallic layer, the electrical discharge aerosol charger further comprising a voltage generator configured to set up a DC voltage between the two metallic layers of the electrode.

14. The electrical discharge aerosol charger according to claim 13, further comprising a voltage generator configured to set up a DC voltage between the outer metallic layer of the first electrode and the body.

15. The electrical discharge aerosol charger according to claim 13, further comprising successive rings polarised with the same polarity as the particles and positioned at the narrowing part of the body, in such a way as to confine the ions in the center of the narrowing part of the body by electrostatic repulsion.

16. The electrical discharge aerosol charger according to claim 13, wherein the narrowing part of the body is composed of two semicylindrical electrodes, powered by an AC current generator, in such a way as to form an oscillating field in the narrowed part of the body.

17. The electrical discharge aerosol charger according to claim 13, wherein the narrowing part of the body is composed of three electrodes powered by a three-phase current generator, in such a way as to form a rotating field in the narrowed part of the body.

18. The electrical discharge aerosol charger according to claim 13, wherein the ion source further comprises a second electrode aligned with the body and the first electrode on the longitudinal axis of symmetry of the electrical discharge aerosol charger.

19. The electrical discharge aerosol charger according to claim 13, further comprising a voltage generator configured to set up a DC voltage between the first and the second electrode.

* * * * *